US010448709B2

(12) United States Patent
Moyes

(10) Patent No.: US 10,448,709 B2
(45) Date of Patent: Oct. 22, 2019

(54) SIDE RELEASE BUCKLE DEVICE

(71) Applicant: Christine Moyes, Tallahassee, FL (US)

(72) Inventor: Christine Moyes, Tallahassee, FL (US)

( * ) Notice: Subject to any disclaimer, the term of this patent is extended or adjusted under 35 U.S.C. 154(b) by 0 days.

(21) Appl. No.: 15/808,107

(22) Filed: Nov. 9, 2017

(65) Prior Publication Data

US 2019/0133259 A1 May 9, 2019

(51) Int. Cl.

| | |
|---|---|
| ***A44B 11/00*** | (2006.01) |
| ***A44B 11/26*** | (2006.01) |
| ***F21S 9/02*** | (2006.01) |
| ***F21V 23/04*** | (2006.01) |
| ***F21V 33/00*** | (2006.01) |
| ***H05B 33/08*** | (2006.01) |
| *F21Y 115/10* | (2016.01) |

(52) U.S. Cl.

CPC ..... *A44B 11/005* (2013.01); *A44B 11/266* (2013.01); *F21S 9/02* (2013.01); *F21V 23/04* (2013.01); *F21V 33/0004* (2013.01); *H05B 33/0806* (2013.01); *F21Y 2115/10* (2016.08)

(58) Field of Classification Search

CPC ..... A44B 11/266; F21S 9/02; F21V 23/04; F21V 33/0004; H05B 33/0806

See application file for complete search history.

(56) References Cited

U.S. PATENT DOCUMENTS 3,381,268 A * 4/1968 Boblitz ..... B60R 22/48 180/270
5,149,189 A * 9/1992 Kawamura ..... A44B 11/2523 24/633
5,181,773 A * 1/1993 Colvin ..... A44B 11/2565 280/801.1
6,965,231 B1 * 11/2005 Cinoglu ..... A61B 5/0555 324/300
9,820,534 B1 * 11/2017 Kelley ..... A44B 11/006
2003/0209088 A1 * 11/2003 Sullivan ..... B60R 22/48 73/862.391
2010/0013622 A1 * 1/2010 Rumps ..... A44B 11/2565 340/457.1
2010/0244543 A1 * 9/2010 Fine ..... B60N 2/2812 297/484
2011/0232052 A1 * 9/2011 Midorikawa ..... A44B 11/2523 24/640
2014/0052342 A1 * 2/2014 Seibert ..... B60N 2/002 701/45

(Continued)

*Primary Examiner* — Robert Sandy
*Assistant Examiner* — David M Upchurch
(74) *Attorney, Agent, or Firm* — Adrienne Love

(57) ABSTRACT

A side release buckle device that has a male member and a female member. The female member has a housing, a catch assembly and at least one contact point. The male member is capable of interlocking with the female member and has an arm assembly, a catch assembly and at least one contact point. At least one switch is formed by the contact between the contact point of the male member and the contact point of the female member. An electrical circuit traverses the female and male member, such that when the members are "locked" together the switch is closed and when the members are apart the switch is open. The electrical circuit has a series of wires, a source of electrical energy, a currently limiting resistor, at least one switch and an electrical element (e.g. light source).

18 Claims, 12 Drawing Sheets

(56) References Cited

U.S. PATENT DOCUMENTS

| | | | | |
|---|---|---|---|---|
| 2014/0239853 | A1* | 8/2014 | Woodham | F21V 33/0064<br>315/362 |
| 2014/0304955 | A1* | 10/2014 | Hortnagl | A44B 11/2573<br>24/595.1 |

* cited by examiner

SIDE RELEASE BUCKLE DEVICE

BACKGROUND OF THE INVENTION

1. Field of the Invention

This invention relates to the field of devices made for a side release buckle device. More specifically, the invention comprises a side release buckle that acts as an electrical switch to power light emitting diodes (LED).

2. Description of the Related Art

Side release buckles 10 are clasps that have a female and male member, as shown in FIG. 1. The male and female members are configured to click together forming a secure connection between loose ends (for purposes of this disclosure, the position in which the two members are joined is referred to as "locked," meaning that the two members are securely connected). The male member 12 is comprised of a catch assembly 14, a rod 16 and two spring arms 15. Each spring arm 15 has a retaining block 18. The female member 13 is comprised of a housing 20 and a catch assembly. Housing 20 has two side holes 22. To latch the buckle 10, the rod 16, and two spring arms 15 slide into housing 20 and retaining block 18 on spring arms 15 pop slightly outward to rest in side hole 22 on each side of housing 20 (the "locked" position). To unlatch the buckle 10, the user presses on retaining block 18 biasing spring arms 15 inward while pulling male member 12 away from female member 13. Side release buckles are typically more secure than hook and loop fasteners (Velcro®) and less burdensome than a standard knot. Therefore, side release buckles are found on various items.

In some instances, side release buckles are used on items for safety, such as helmets, car seats, safety vests and life jackets. In other instances, side release buckles are used for practical fashion, such as fanny packs, belts, backpacks, luggage, shoulder bags, jackets and pet collars.

Oftentimes light emitting diodes or LEDs are embedded in textiles or plastics (such as helmets). Light emitting diodes or LEDs are small light bulbs that do not include a filament that will burn out. LEDs stay cool to the touch have a longer lifespan than a typical incandescent bulb. Because of these characteristics LEDs is ideal for implementation on or in the types of items discussed above. However, to activate these LEDs a small button or switch located somewhere on the item must be pushed or engaged. A switch is an electrical component that can open or close an electrical circuit, as shown in FIG. 2-4, electrical schematic diagrams. FIG. 2 is a prior art simple circuit diagram to drive an LED. The switch selectively couples electrical energy from battery B 130 to a light source (LED) 120 for selectively producing light. The battery 130 is connected in series with a current limiting resistor (ballast resistor) 110 and an LED 120. FIG. 3 shows a circuit diagram driving LEDs in parallel. Although somewhat more problematic, it is possible to have parallel LEDs. A LED circuit with an integrated chip is shown in FIG. 4. The integrated chip 140 allows for greater control over the LED circuit (e.g. lights can be programmed to flash or slowly change colors).

In each type of embedded LED item, the user is required to turn on and off the LED switch which often results in a user failing to activate or deactivate the LEDs. Thus, the user might run down the battery by leaving the switch closed (LEDs on) or fail to activate the LEDs when using the item. Therefore, what is needed is a device that activates the LEDs when the user closes or "locks" the buckle on an item. The present invention achieves this objective, as well as others that are explained in the following description.

BRIEF SUMMARY OF THE INVENTION

The present invention is a side release buckle device. The device is comprised of a male member and a female member. The female member has a housing, a catch assembly (for connection to a strap and/or item) and at least one conductive contact point. The male member is capable of interlocking with the female member and has an arm assembly, a catch assembly and at least one conductive contact point. At least one switch is formed by the contact between the conductive contact point of the male member and the conductive contact point of the female member. An electrical circuit traverses the female and male member, such that when the members are "locked" together the switch is closed and when the members are apart the switch is open. The electrical circuit has a series of wires, a source of electrical energy, a currently limiting resistor, at least one switch and a light source (or other electrical element). The light source is preferably light emitting diodes. The LEDs can be integrated into any item. For example, the item could be a belt, a safety vest, a backpack or anything else that can utilize a side release buckle.

When the side release buckle device is locked (male member and female member are closed together) the LEDs turn on and when the buckle is released the LEDs turn off. This feature allows a user to avoid having to engage an on or off switch when utilizing an item.

BRIEF DESCRIPTION OF THE SEVERAL VIEWS THE DRAWINGS

FIG, 11 is a schematic diagram, showing another embodiment of the LED electrical circuit.

Figure 12:
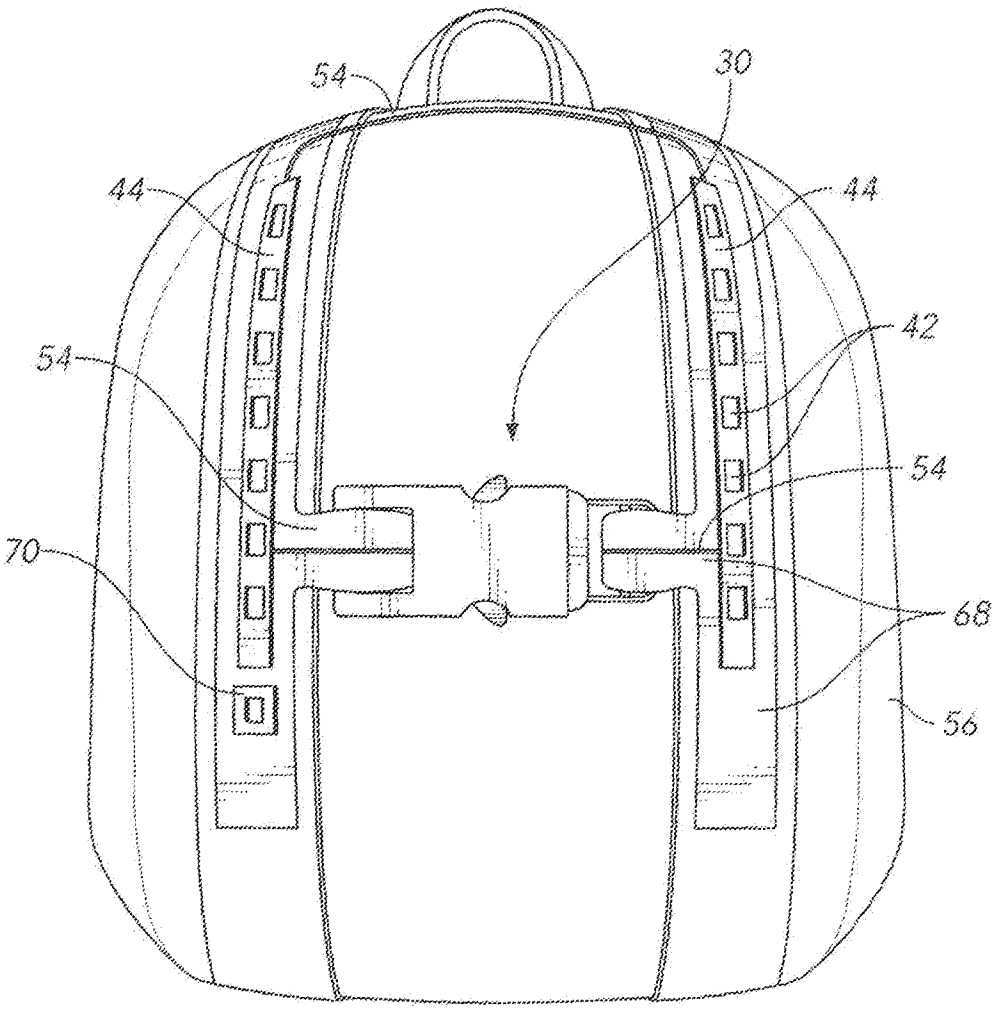

FIG. 12 is a perspective view, showing the side release buckle device on an item.

Figure 13:
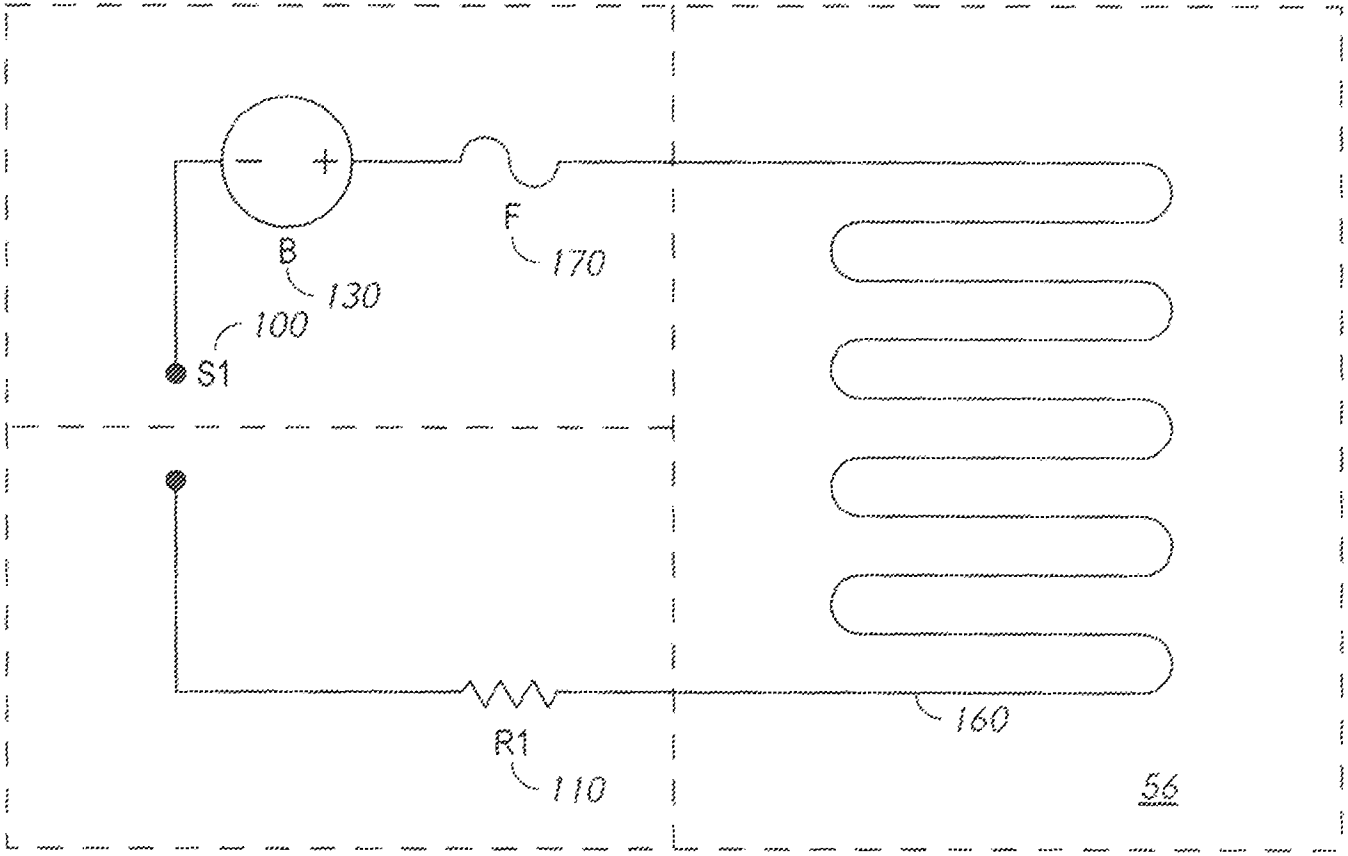

FIG. 13 is a schematic diagram, showing a heating element in another embodiment of the electrical circuit.

REFERENCE NUMERALS IN THE DRAWINGS

10 side release buckle
12 male member
13 female member
14 catch assembly
15 spring arm
16 rod
18 retaining block

20 housing
22 side opening
24 catch assembly
26 first contact point
27 second contact point
28 housing
30 side release buckle device
32 male member
33 female member
34 rod
36 catch assembly
38 retaining block
39 spring arm
40 side opening
42 LED
44 LED strip
46 arm assembly
48 arm assembly wire
50 first housing contact point
52 second housing contact point
54 wiring
56 item
58 first electrical circuit
59 second electrical circuit
60 first switch
62 second switch
64 contact point
66 contact point
8 straps
70 USB
100 first switch
110 resistor
120 light emitting diode
130 charge (battery)
140 second switch
150 integrated chip
160 heating strip
170 fuse

DETAILED DESCRIPTION OF THE INVENTION

Figure 1:
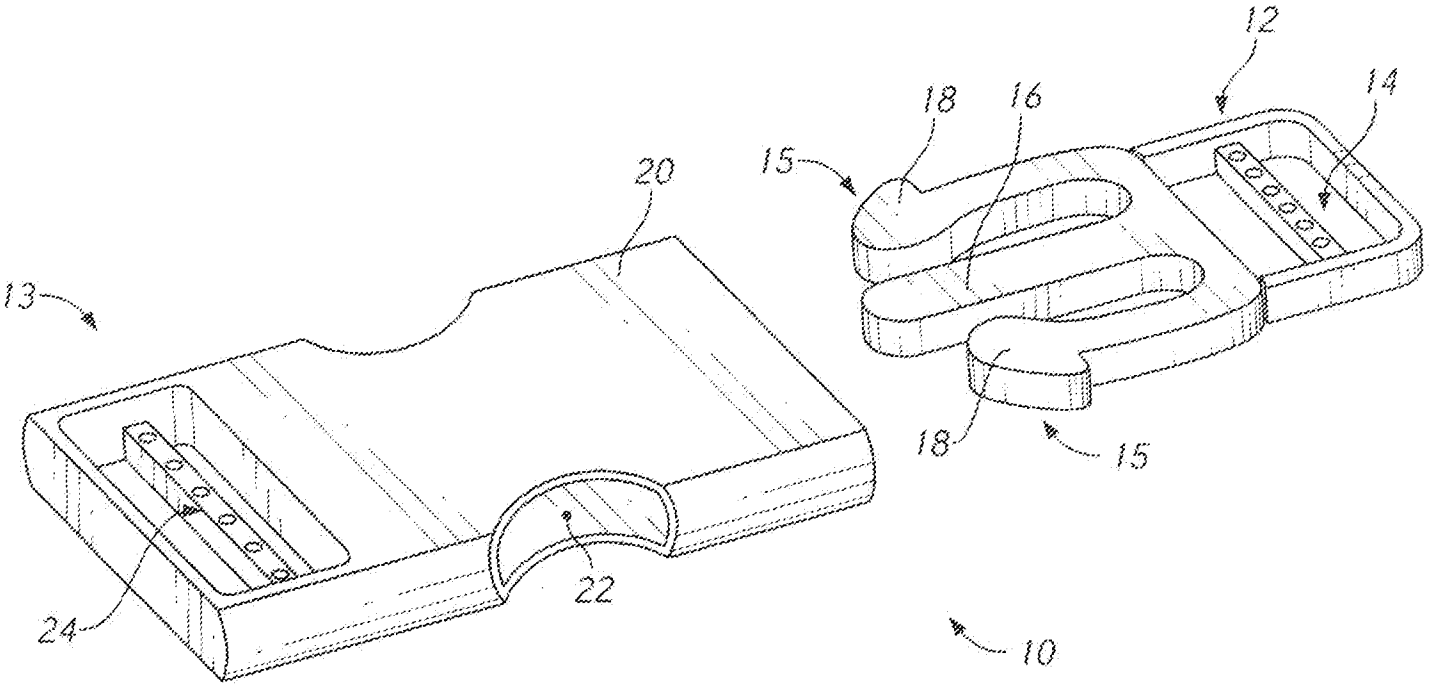
FIG. 1 (PRIOR ART)
FIG. 1 is a perspective view, showing a prior art side release buckle.
Figure 2:
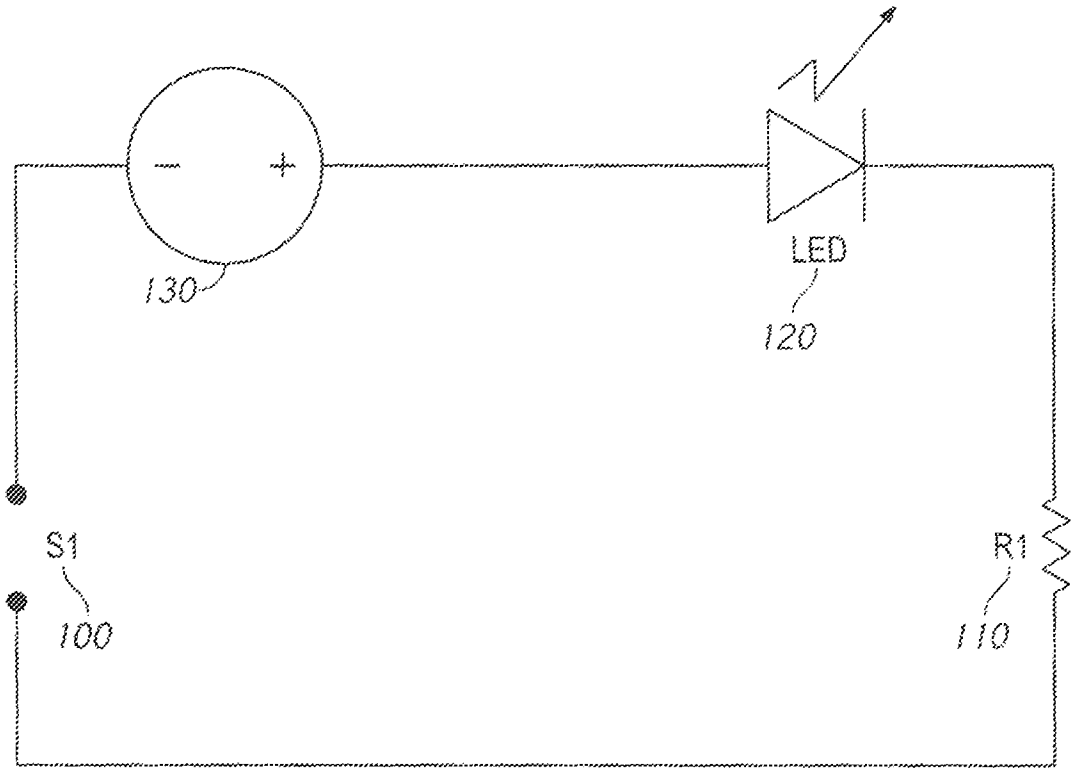
FIG. 2 (PRIOR ART)
FIG. 2 is a schematic diagram, showing a prior art simple circuit to drive an LED
Figure 3:
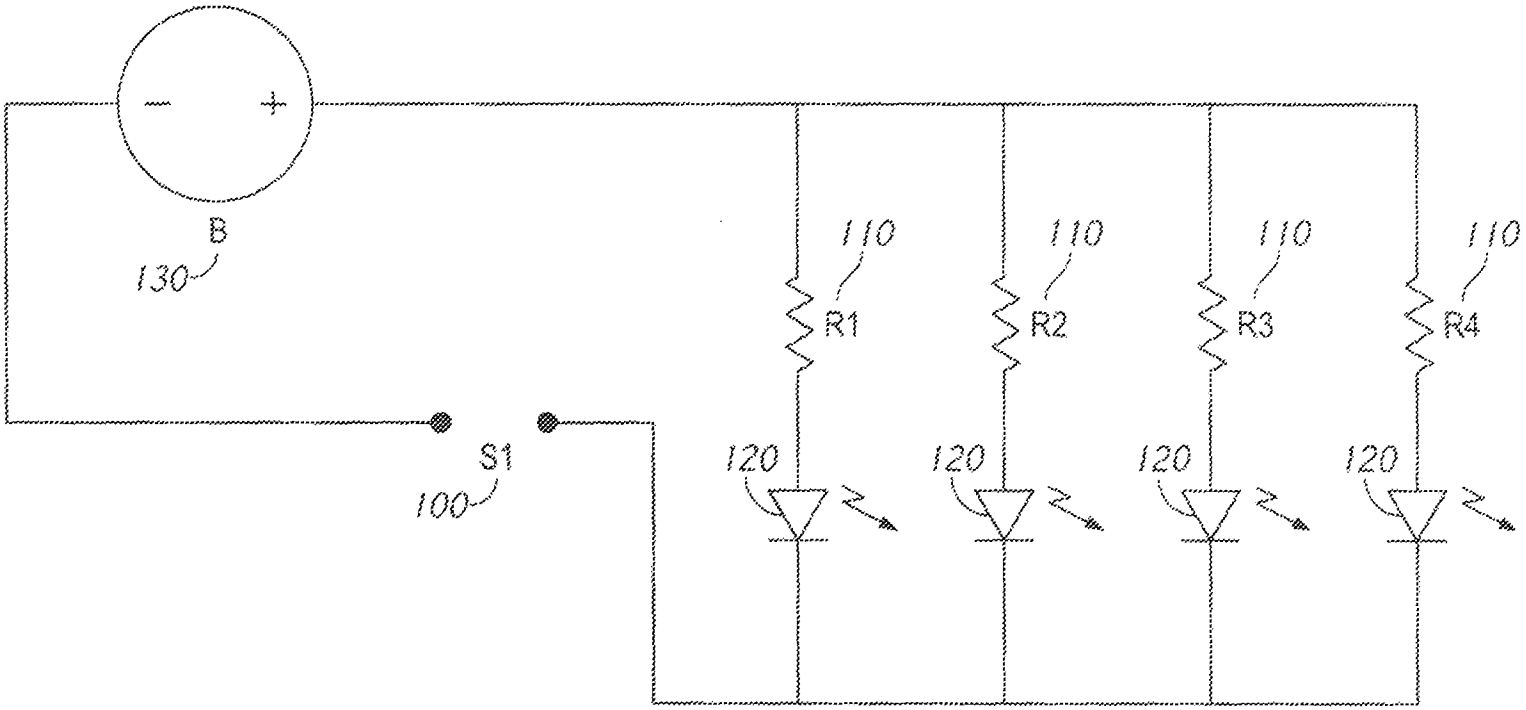
FIG. 3 (PRIOR ART)
FIG. 3 is a schematic diagram, showing a prion art circuit diagram driving LEDs in parallel.
Figure 4:
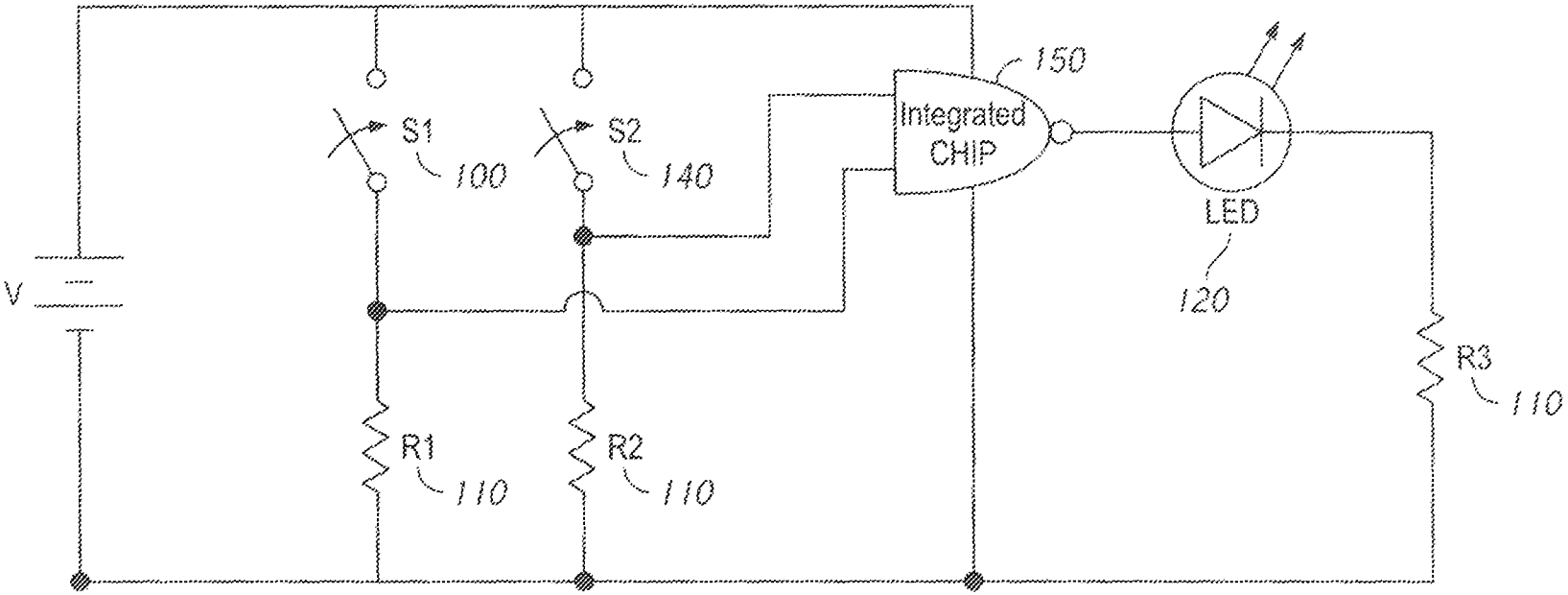
FIG. 4 (PRIOR ART)
FIG. 4 is a schematic diagram, showing prior LED electrical circuit with an integrated chip.
Figure 5:
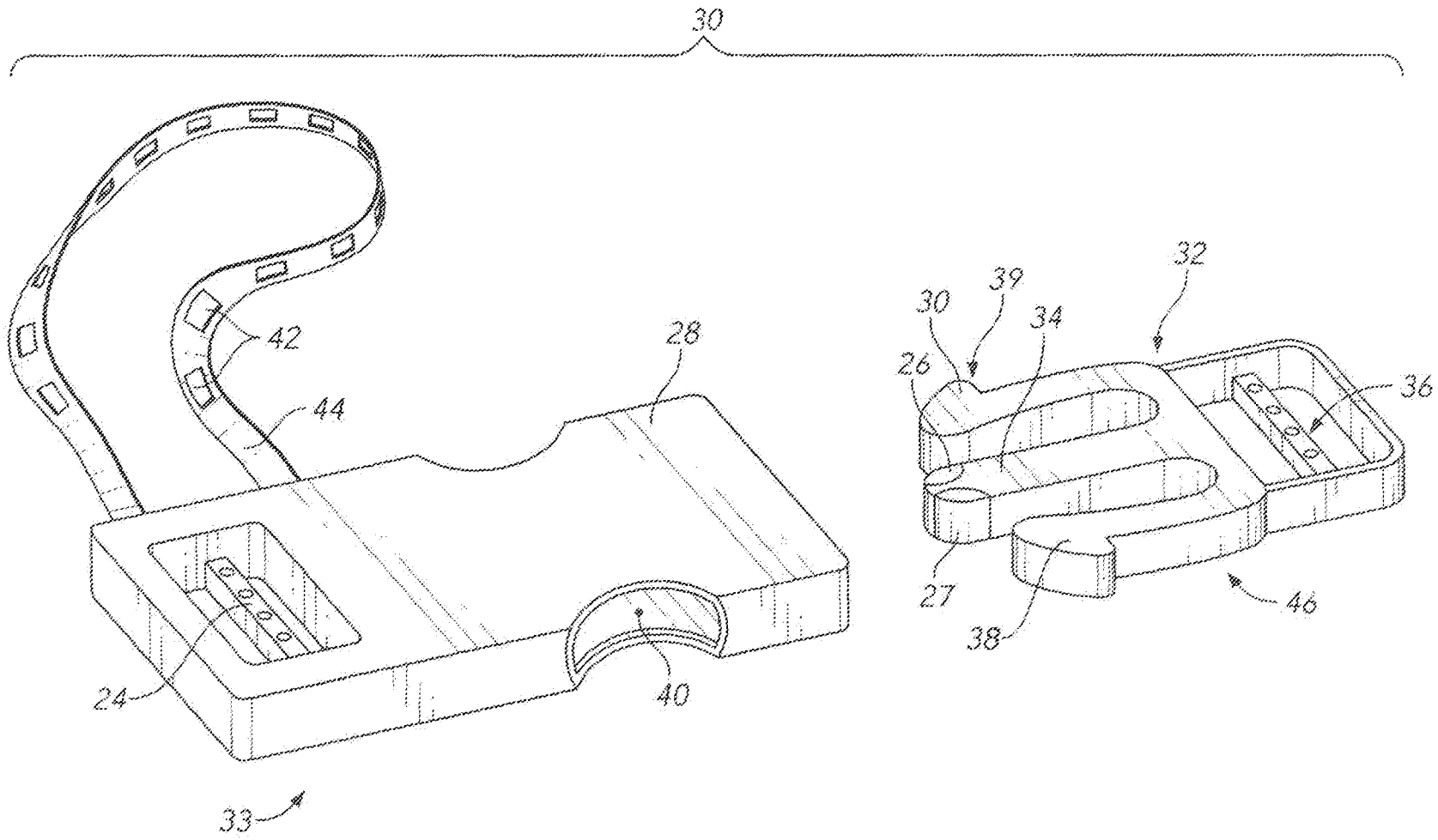
FIG. 5 is a perspective view, showing the side release buckle device.

Side release buckle device 30 has a female member 33 and a male member 32 configured to interlock and easily release, as shown in FIG. 5. An electrical circuit 58, 59 (shown in FIGS. 7 and 11) transverses female member 33 and male member 32 and has a source of electrical energy 130 (e.g. a battery), a current limiting resistor 110 (e.g. a ballast resistor), at least one switch (100, 140) and a light-emitting diode ("LED") 120. While this electrical circuit 58, 59 is shown, electrical circuit 58, 59 could be any known electrical circuit. For example, LED 120 could be any electrical element (e.g. heating strip 160). Light source 120 is connected to or embedded in item 56 (illustrated in FIG. 12). In one embodiment, these elements are connected in series, as set out in FIG. 7. When male member 32 and female member 33 are connected the switch(es) 100, 140 are closed, thereby completing the circuit 58 and providing power to light source 120.

Returning to FIG. 5, side release buckle device 30 is shown in one embodiment, without item attached. Instead, LED strip 44, including LEDs 42 are shown extending directly out of female member 30. The reader will appreciate that LED strip 44 can extend outward in any direction from female member 30 and is preferably connected to or integrated with item (not shown). For example LED strip 44 could extend outward in the direction of catch assembly 24 on female member 30, such that if there is a belt or strap secured therein, the LED strip 44 is seamlessly integrated with that belt or strap. Male member 39 has an arm assembly 46 comprised of two spring arms 39, each having a retaining block 38 and a central rod 34. In one embodiment, rod 34 includes a first contact point 26 and a second contact point 27. While the contact points are shown on rod 34, contact points can be located at any point on male member 32 where male member 32 contacts female member 33 in a "locked" position. Contact points can be made of any conductive material. For example, contact point could simply be a portion of the arm assembly 46 itself, with a thin layer of nickel on the surface (a process known as nickel electroplating). Wiring 54 (shown in FIG. 8-9) is required to connect all portions of the electrical circuit (58, 59) other than switches (60,62).

Figure 6:
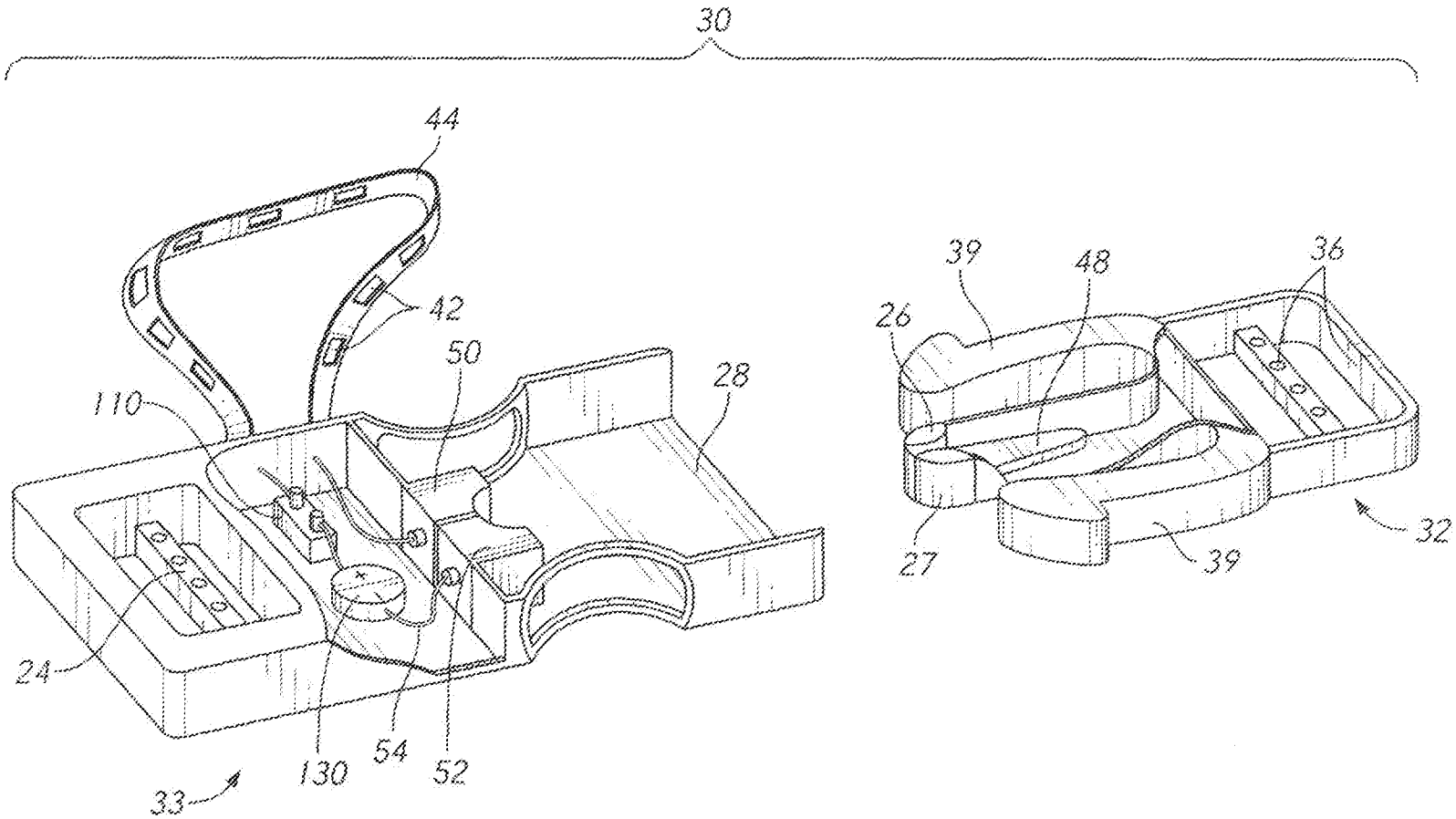
FIG. 6 is a cut away view, showing the side release buckle device and internal components.

FIG. 6 is a cut away view, showing the internal components of male member 32 and female member 33 proximate contact points 26, 27. Arm assembly wire 48 connects first contact point 26 to second contact point 27 of rod 34. In this embodiment, a large portion of electrical circuit 58 is housed within housing 28 of female member 33, such that electrical circuit 58 is not visible. Female member 33 includes a source of electrical energy, in this case a battery 130 that is connected in series through wiring 54 with a ballast resistor 110. Two switches (60, 62) are formed by the connection between female member 33 and male member 32, as shown in FIG. 6-9. Specifically, a first switch 60 is formed between a first contact point 50 on female member 33 and a first contact point 26 on male member 32. A second switch 62 is formed between a second contact point 52 on female member 33 and a second contact point 27 on a male member 32.

Figure 7:
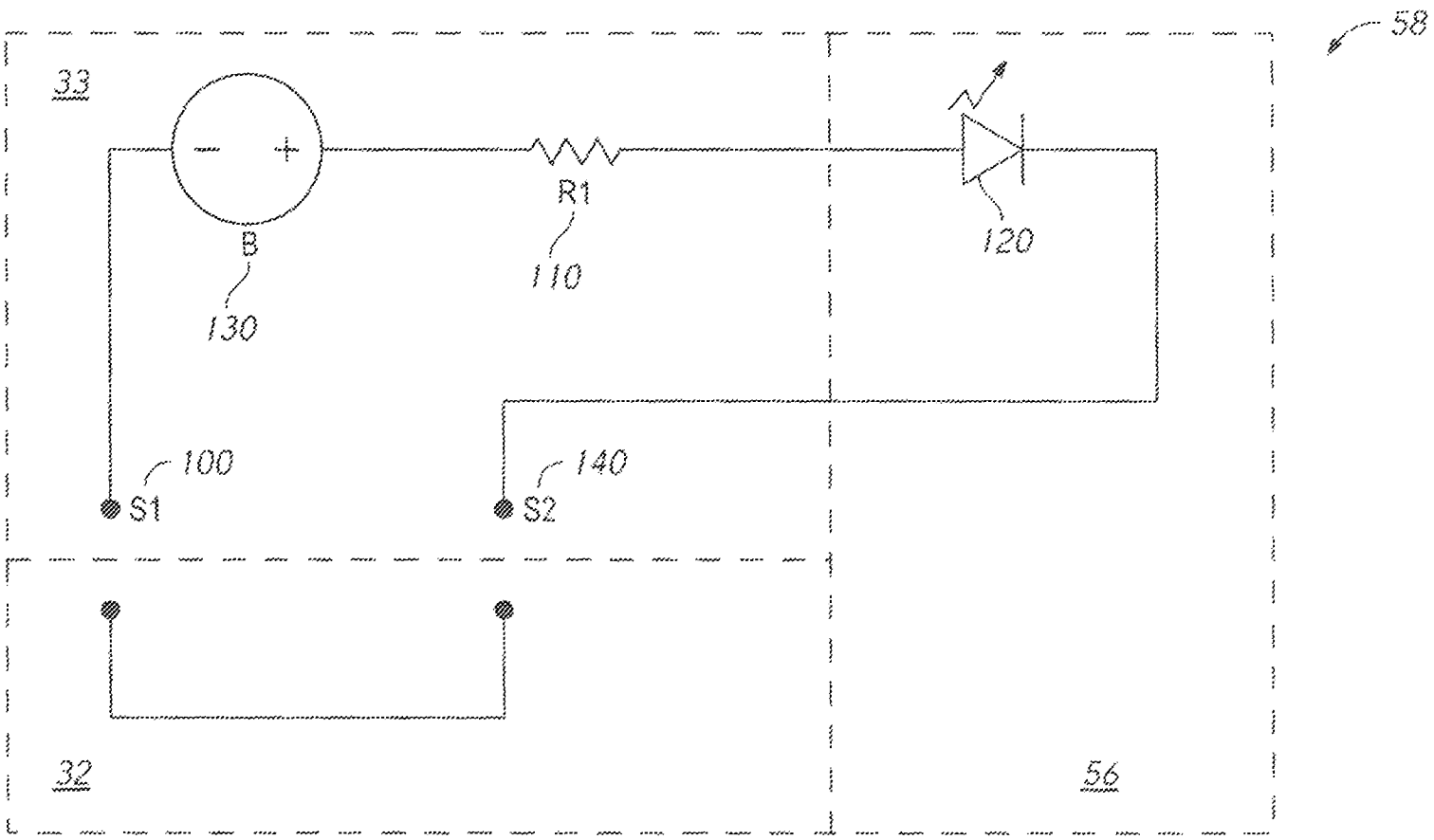
FIG. 7 is a schematic diagram, showing the present LED electrical circuit.

A schematic view of the electrical circuit 58 is shown in FIG. 7. Battery 130 is connected in series with a resistor 110, LED 120 and two switches 100, 140. As shown, the electrical circuit 58 transverses male member 32 and female member 33, with closed switches 100, 140 formed by the contact between male member 32 and female member 33. While the battery 130 and resistor 110 are shown in female member 33, these components could also be housed within male member 32, so long as the electrical circuit 58 is complete.

Figure 9:
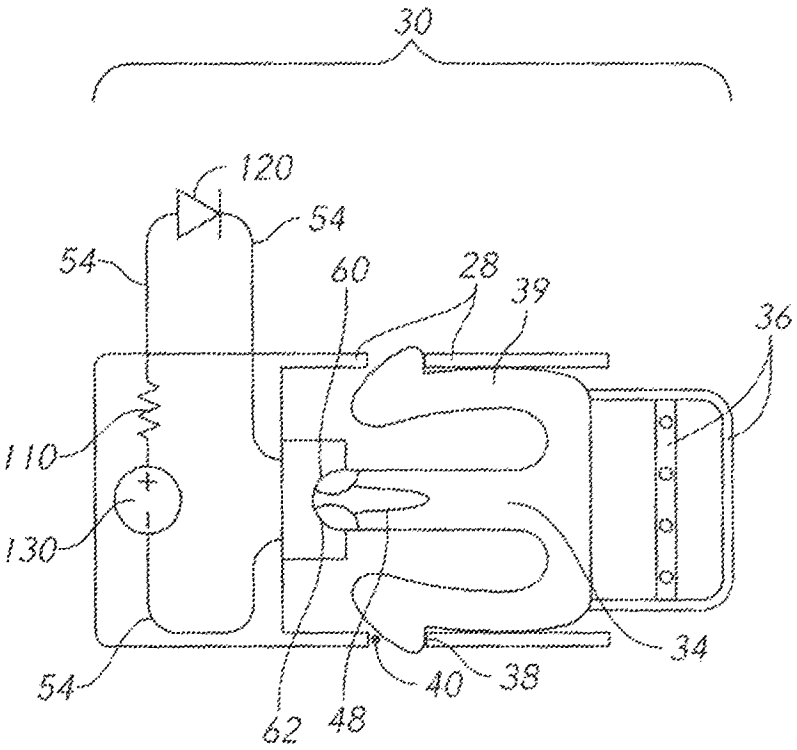
FIG. 9 is a schematic diagram, showing the pie sent side release buckle device with switches closed.
Figure 8:
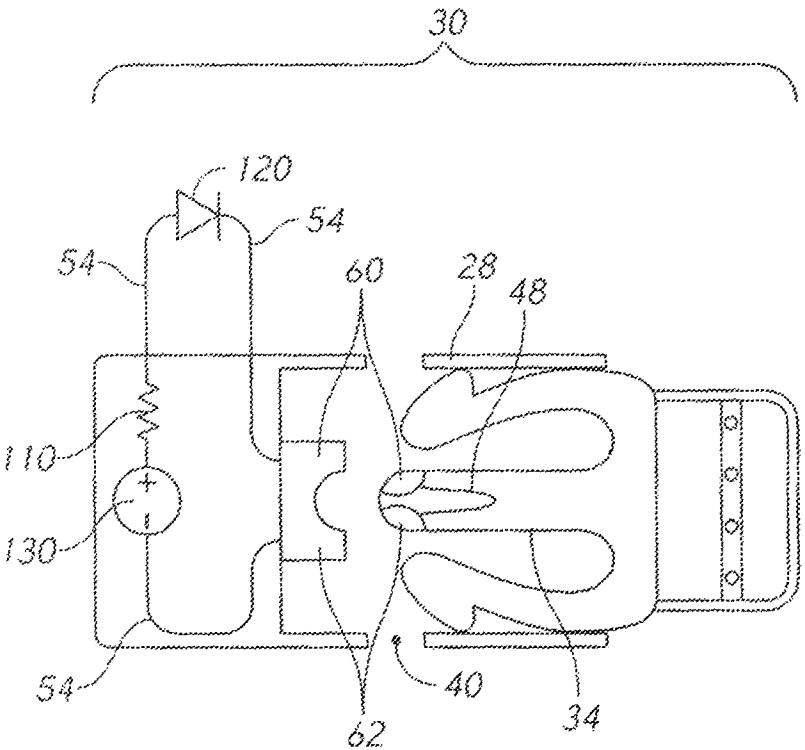
FIG. 8 is a schematic diagram, showing the present side release buckle device with switches open.

The device 30 is shown with switches (60, 62) open in FIG. 8, wherein the contact points are not touching and therefore light source 120 is off. In FIG. 9, the switches (60, 62) are closed (contact points are touching) thereby completing the circuit and illuminating the light source 120. Therefore, when a user "unlocks" or disconnects the two members (32, 33), the light source 120 is off, thereby conserving energy. When a user connects the two members (32, 33) together the light source 120 turns on, thereby ensuring that the light source 120 is on.

Figure 10:
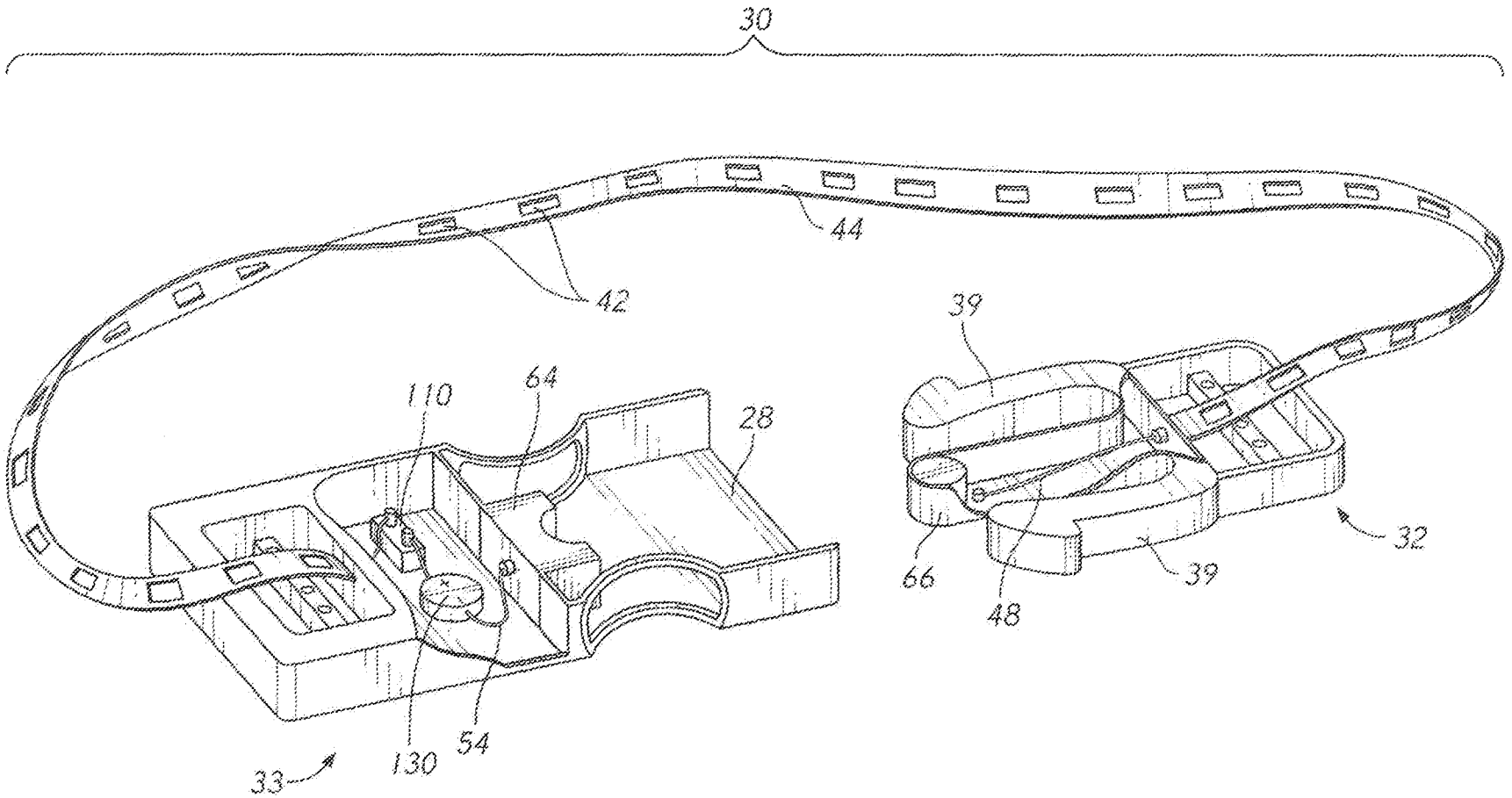
FIG. 10 is a cut away view, showing another embodiment of the side release buckle device.
Figure 11:
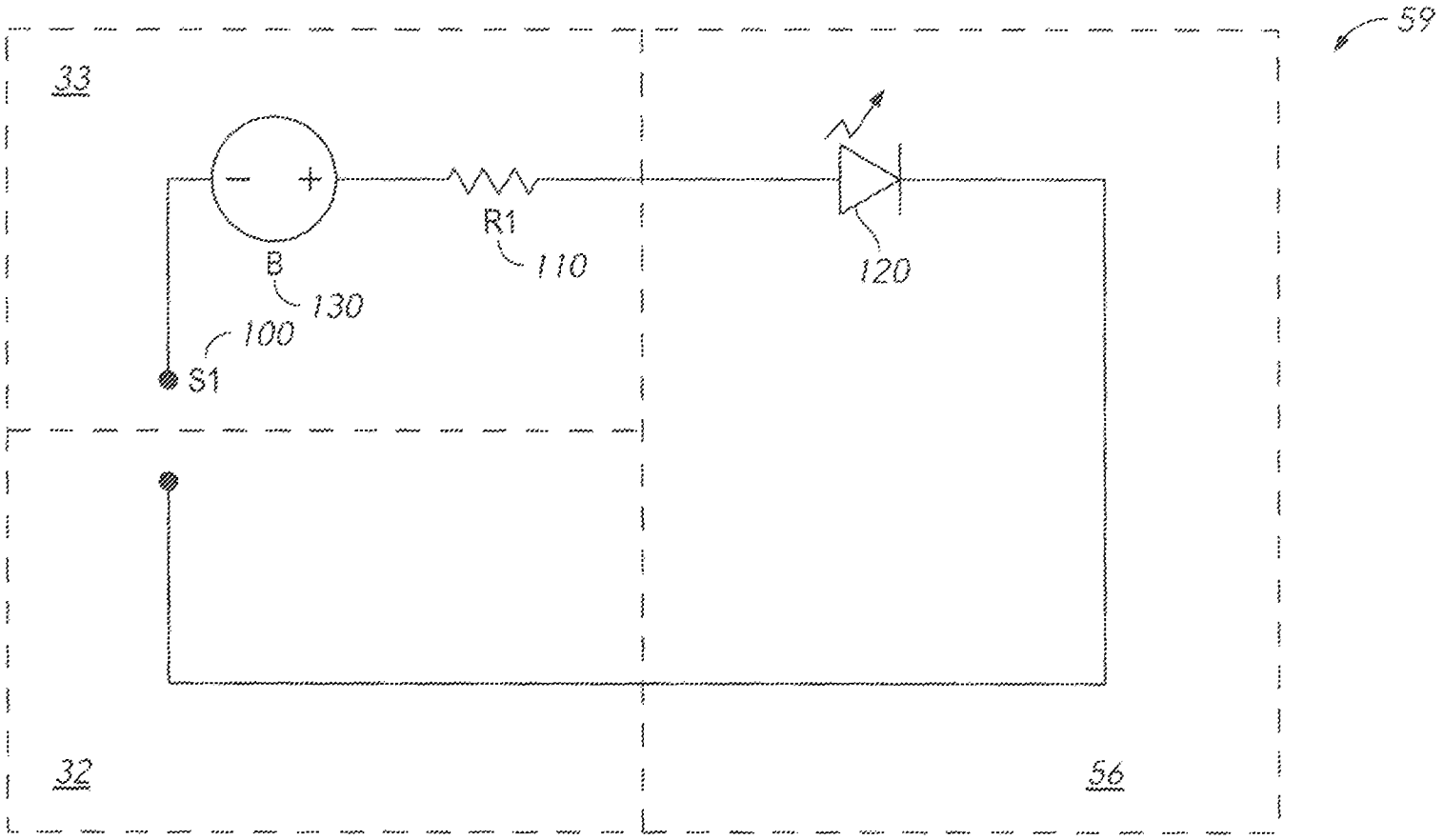

A second embodiment of device 30 is shown in FIG. 10 and 11. In the second embodiment, resistor 110 and battery 130 are connected through wiring 54 to contact point 64. One switch 100 is formed between contact point 64 and contact point 66. Arm assembly wire 48 connects contact point 66 to LED strip 44 which includes embedded wiring which runs between each LED 42. LED strip 44 can be embedded or connected to any item and return to female member 33 to complete the electrical circuit 59.

The reader will appreciate that the present device 30 can be applied to any type of item that can incorporate a side buckle release device 30. Some examples include safety items, such as helmets, life preserving vests, safety or construction vests and practical fashion items, such as fanny packs, belts, backpacks, luggage, shoulder bags, jackets and pet collars. Several items require waterproofing material and therefore the side buckle release device 30 should be securely waterproof. A backpack is shown as item 56 in FIG. 12. Wiring 54 can extend through straps 68 to LED strip 44. Additional wiring 54 can be embedded or hidden within backpack material to connect LED strips 44 together and complete the circuit 59. The present invention should not be limited to powering LEDs 42. It should be known that other electrical components could be powered by device, such as a heating element or Global Positioning System unit. Another electrical circuit is shown in FIG. 13, wherein healing element 160 is connected in circuit with fuse 170, battery 130 and resistor 110. Thus, when the switch 100 is closed, heating element 160 is activated. Any known GPS unit (such as TrackR®, headquartered in Santa Barbara, Calif.) could also be integrated into the device, allowing a user to use locational services.

Further, a USB charging port 70 can be integrated into the design to allow the use of a rechargeable battery 130. The user could easily plug the device into an external power source for charging purposes.

The preceding description contains significant detail regarding the novel aspects of the present invention. It should not be construed, however, as limiting the scope of the invention but rather as providing illustrations of the preferred embodiments of the invention. As an example, the electrical circuit 58, 59 can be configured to provide power through one switch or two switches. Additionally, the battery 130 and resistor 110 could be housed in the male member 32 as opposed to the female member 33. Thus, the scope of the invention should be fixed by the following claims, rather than by the examples given.

Having described my invention, I claim:

1. A side buckle release device, said side buckle release device comprising:

a female member, having a housing and a first catch assembly, wherein said housing is connected to said first catch assembly, a male member configured to interlock with said female member, wherein said male member has a second catch assembly connected to an arm assembly, wherein said arm assembly of said male member comprises at least two spring arms each having a retaining block, an electrical circuit traversing said female member and said male member, wherein said electrical circuit has a series of wires a source of electrical energy a current limiting resistor, a first switch, a second switch, wherein said first switch and said second switch are closed when said male member fully engages with said female member, an electrical element, and wherein said electrical element extends outward away from said side release buckle device.

2. The side buckle release device of claim 1, wherein said source of electrical energy is connected in series with said current limiting resistor and said electrical element via said series of wires.

3. The side buckle release device of claim 2, wherein said source of electrical energy and said current limiting resistor are fully housed in said housing of said female member.

4. The side buckle release o claim 3, wherein said arm assembly of said male member further comprises, a rod having a first contact point and a second contact point, wherein said first contact point and said second contact point are connected by a first wire.

5. The side buckle release device of claim 4, wherein said housing of said female member further comprises a first contact point and a second contact point, wherein said first contact point is connected to said electrical element via a wire and said second contact point is connected to said source of electrical energy via a wire.

6. The side buckle release device of claim 5, wherein said first switch is formed by said first contact point of said rod and said first contact point of said housing; and wherein said second switch is formed by a second rod contact point and a second housing contact point.

7. The side buckle release device of claim 1, wherein said electrical element is a light source.

8. The side buckle release device of claim 1, wherein said source of electrical energy is a battery.

9. The side buckle release device of claim 1, wherein said currently limiting resistor is a ballast resistor.

10. The side buckle release of claim 7, wherein said light source is a light emitting diode.

11. A side buckle release device, said buckle release device comprising:

a female member, having a housing, a first catch assembly and a contact point, wherein said housing is connected to said first catch assembly, a male member configured to interlock with said female member, wherein said male member has a second catch assembly connected to an arm assembly and a contact point, wherein said arm assembly of said male member comprises at least two spring arms each having a retaining block, an electrical circuit traversing said female and said male member, wherein said electrical circuit has a series of wires, a source of electrical energy, a current limiting resistor, a first switch, wherein said first switch is closed when said male member fully engages with said female member, wherein said series of wires has an arm assembly wire within said arm assembly of said male member and wiring within said housing of said female member, a light source having a first end and a second end, and wherein said light source extends outward away from said side release buckle device.

12. The side buckle release device of claim 11, wherein said source of electrical energy is connected in series with said current limiting resistor, said first end of said light source and said contact point of said female member via said series of wires.

13. The side buckle release device of claim 12, wherein said source of electrical energy and said current limiting resistor are fully housed in said housing of said female member.

14. The side buckle release device of claim 13, wherein said arm assembly of said male member further comprises, a rod, wherein said contact point of said male member is proximate said end of said rod, wherein said contact point is connected by a first wire to said second end of said light source.

15. The side buckle release device of claim 14, wherein said first switch is formed by said contact point of said female member and said contact point of said male member.

16. The side buckle release device of claim 11, wherein said source of electrical energy is a battery.

17. The side buckle release device of claim 11, wherein said currently limiting resistor is a ballast resistor.

18. The side buckle release device of claim 11, wherein said light source is a light emitting diode.

* * * * *